US009080786B2

(12) United States Patent
Rowland

(10) Patent No.: US 9,080,786 B2
(45) Date of Patent: Jul. 14, 2015

(54) DROP-FRONT DRAIN PAN

(75) Inventor: Jay F. Rowland, Johns Creek, GA (US)

(73) Assignee: J.F.R. Enterprises, Inc., Johns Creek, GA (US)

( * ) Notice: Subject to any disclaimer, the term of this patent is extended or adjusted under 35 U.S.C. 154(b) by 503 days.

(21) Appl. No.: 13/542,866

(22) Filed: Jul. 6, 2012

(65) Prior Publication Data

US 2013/0008526 A1 Jan. 10, 2013

Related U.S. Application Data

(60) Provisional application No. 61/504,767, filed on Jul. 6, 2011.

(51) Int. Cl.

| | |
|---|---|
| ***F25D 21/14*** | (2006.01) |
| ***F24F 13/22*** | (2006.01) |
| ***F28F 17/00*** | (2006.01) |

(52) U.S. Cl.

CPC ..... *F24F 13/222* (2013.01); *F25D 21/14* (2013.01); *F28F 17/005* (2013.01); *Y10T 137/5762* (2015.04)

(58) Field of Classification Search

USPC ..... 137/312–314; 62/285, 291; 220/571; 222/108; 141/86; 184/106; 296/38

See application file for complete search history.

(56) References Cited

U.S. PATENT DOCUMENTS

| | | | | |
|---|---|---|---|---|
| D32,575 | S | 4/1900 | Stevenson | |
| 1,487,065 | A | 3/1924 | Irons | |
| 1,584,175 | A | 5/1926 | Irons | |
| 1,684,558 | A * | 9/1928 | Schwarz | 62/288 |
| 1,915,849 | A | 6/1933 | Crimmel | |
| 1,986,992 | A * | 1/1935 | Wolfe | 222/108 |
| 2,114,878 | A * | 4/1938 | Harbison | 62/291 |
| 2,141,270 | A * | 12/1938 | Frykdahl | 62/413 |
| 2,215,665 | A * | 9/1940 | Hedlund | 62/286 |
| 2,231,817 | A * | 2/1941 | Quimper | 62/382 |
| 2,934,003 | A | 4/1960 | Ladymon | |
| 3,224,216 | A | 12/1965 | Crouch | |
| 3,292,688 | A * | 12/1966 | Shrader | 165/122 |
| 3,318,107 | A | 5/1967 | Riley | |
| 3,367,132 | A | 2/1968 | Elliott | |
| 3,480,178 | A | 11/1969 | Morgan | |
| 3,689,037 | A * | 9/1972 | Payne | 261/105 |
| 3,724,233 | A | 4/1973 | Pugh et al. | |

(Continued)

FOREIGN PATENT DOCUMENTS

| | | |
|---|---|---|
| DE | 2650288 | 5/1978 |
| EP | WO0039512 | 7/2000 |
| KR | 200402748 | 3/2004 |

*Primary Examiner* — Kevin Murphy
*Assistant Examiner* — Jonathan Waddy
(74) *Attorney, Agent, or Firm* — Eric W. Cernyar

(57) ABSTRACT

A secondary condensate drop-front drain pan comprises a drainage basin formed by a main basin portion, an auxiliary basin portion, and sidewalls that extend upwardly around a perimeter of the drain pan from both the main and auxiliary basin portions. The auxiliary basin portion, which is located along a side of the pan, is stepped down relative to the main basin portion. A transition portion between the main and auxiliary basin portions may be flexible or convertible and operative to configure the drain pan between a stepped configuration and a standard or substantially flat configuration. Downwardly extending projections or lugs may descend below the plane of the drainage basin to form notches or saddles for straddling or mounting the drain pan to support beams. The drain pan may be nestably stackable.

20 Claims, 12 Drawing Sheets

(56) References Cited

U.S. PATENT DOCUMENTS

| | | | | | |
|---|---|---|---|---|---|
| 3,788,581 | A | | 1/1974 | Rutzick | |
| 3,790,115 | A | | 2/1974 | Fox | |
| 3,834,527 | A | * | 9/1974 | Howe | 206/494 |
| 3,848,546 | A | | 11/1974 | Lawlor | |
| 3,888,090 | A | | 6/1975 | Meyer | |
| 4,243,197 | A | | 1/1981 | Wright | |
| D262,104 | S | | 12/1981 | Simpson | |
| D271,328 | S | | 11/1983 | Lanier et al. | |
| 4,480,748 | A | | 11/1984 | Wind | |
| 4,484,661 | A | | 11/1984 | Evenson | |
| 4,604,874 | A | | 8/1986 | Seeley | |
| 4,644,753 | A | | 2/1987 | Burke | |
| 4,653,651 | A | | 3/1987 | Flum | |
| 4,677,947 | A | * | 7/1987 | Bousquet | 123/195 C |
| 4,687,604 | A | | 8/1987 | Goettl | |
| 4,733,790 | A | | 3/1988 | Stein | |
| 4,783,971 | A | | 11/1988 | Alba | |
| 4,814,752 | A | | 3/1989 | Lehman | |
| 4,835,984 | A | | 6/1989 | Vyavaharkar | |
| 4,869,456 | A | | 9/1989 | Jacobs | |
| 4,917,581 | A | | 4/1990 | Richardson | |
| D308,247 | S | | 5/1990 | Adam | |
| 4,930,632 | A | | 6/1990 | Eckert | |
| D309,571 | S | | 7/1990 | Lehman | |
| 5,076,534 | A | | 12/1991 | Adam | |
| 5,133,167 | A | * | 7/1992 | Drew et al. | 52/506.08 |
| 5,147,039 | A | | 9/1992 | Sechler | |
| 5,224,508 | A | | 7/1993 | Bates | |
| 5,230,601 | A | | 7/1993 | Apps et al. | |
| 5,249,699 | A | | 10/1993 | Williams | |
| 5,307,931 | A | | 5/1994 | Gillispie | |
| 5,316,386 | A | * | 5/1994 | Moore | 383/10 |
| D353,665 | S | | 12/1994 | Jennings | |
| 5,392,944 | A | | 2/1995 | Jennings | |
| 5,429,236 | A | | 7/1995 | Evans | |
| 5,511,386 | A | | 4/1996 | Russ | |
| 5,848,536 | A | | 12/1998 | Dodge | |
| 5,881,566 | A | | 3/1999 | Shacklock | |
| 5,904,053 | A | | 5/1999 | Polk | |
| 5,961,093 | A | | 10/1999 | Jones | |
| 6,065,531 | A | | 5/2000 | Schneider | |
| 6,112,536 | A | | 9/2000 | Hansen | |
| 6,125,647 | A | | 10/2000 | Martinez | |
| 6,167,716 | B1 | * | 1/2001 | Fredrick | 62/283 |
| 6,286,328 | B1 | | 9/2001 | Kawahara | |
| 6,360,911 | B1 | | 3/2002 | Arnold | |
| 6,382,108 | B1 | | 5/2002 | Stanek | |
| D485,283 | S | | 1/2004 | Shuck | |
| 6,718,788 | B1 | | 4/2004 | Shuck | |
| 6,766,615 | B2 | | 7/2004 | Smead | |
| 6,797,894 | B2 | | 9/2004 | Montagnino et al. | |
| 6,868,689 | B1 | | 3/2005 | McNeil et al. | |
| 6,895,770 | B1 | * | 5/2005 | Kaminski | 62/285 |
| 6,978,909 | B2 | | 12/2005 | Goetzinger | |
| D562,963 | S | | 2/2008 | Cantolino | |
| 7,637,387 | B1 | | 12/2009 | Cantolino | |
| D608,917 | S | | 1/2010 | Ward et al. | |
| 7,673,646 | B1 | | 3/2010 | Cantolino | |
| 7,878,019 | B2 | | 2/2011 | Cantolino | |
| 7,891,635 | B2 | | 2/2011 | Rowland | |
| 7,900,795 | B1 | | 3/2011 | Cantolino | |
| 8,100,140 | B1 | | 1/2012 | Cantolino | |
| 8,122,733 | B2 | | 2/2012 | Raab | |
| 8,136,782 | B2 | | 3/2012 | Rowland | |
| 8,152,129 | B2 | | 4/2012 | Hermans | |
| 8,177,093 | B1 | * | 5/2012 | Paul | 220/571 |
| 8,220,768 | B1 | | 7/2012 | Cantolino | |
| 8,920,546 | B2 | * | 12/2014 | Ball et al. | 96/112 |
| 2002/0000093 | A1 | | 1/2002 | Lea | |
| 2002/0023293 | A1 | * | 2/2002 | Lewis | 4/251.1 |
| 2005/0138940 | A1 | * | 6/2005 | Spanger | 62/150 |
| 2006/0144071 | A1 | | 7/2006 | Rowland | |
| 2008/0029684 | A1 | * | 2/2008 | Rowland | 248/678 |
| 2008/0047289 | A1 | * | 2/2008 | Patrick et al. | 62/285 |
| 2009/0261108 | A1 | * | 10/2009 | Steinberg | 220/571 |
| 2010/0018980 | A1 | | 1/2010 | Oakner | |
| 2010/0078243 | A1 | * | 4/2010 | Tokarik | 180/69.1 |
| 2011/0088423 | A1 | | 4/2011 | Ieardi | |

* cited by examiner

DROP-FRONT DRAIN PAN

RELATED APPLICATIONS

This application claims priority to my U.S. provisional patent application Ser. No. 61/504,767, filed Jul. 6, 2011, entitled "Drop-front Drain Pan."

FIELD OF THE INVENTION

This invention relates to drain pans for air handling units, and more particularly, to secondary or overflow drain pans for forced air conditioning systems.

BACKGROUND OF THE INVENTION

As air passes over the evaporator coil inside an air handler, such as one used with a split air conditioning or heat pump system, condensate forms on the coil. This condensate descends from the coil into the primary drain pan inside the air handler. In case the primary pan overflows, contractors often install a secondary, or emergency, drain pan under the air handler.

A secondary drain pan is typically made of plastic or metal and is rectangular or round in shape. Common pan sizes range from 18"×46" to 36"×60" to 34"×79". Such a pan typically has side walls that define a basin that contains a waterway that allows drainage to exit through a drainage hole. The secondary pan rests on a platform or hangs under suspended equipment.

Secondary drain pans should be maneuverable enough to fit through attic or crawlspace doors. For cost, handling, and code considerations, plastic pans are generally made from a minimum 0.065" thick material, and sturdier pans may be 0.125" thick, or more. Sheet metal pans generally have a minimum thickness of 0.0236" (24 gage).

A variety of methods and materials, some referred to as risers, are employed in the field in order to elevate the installed equipment above the level of any water that may collect in the pan. Equipment may be elevated further to provide proper drainage pitch for the primary drain line and easy access to equipment panels. This elevation is achieved by using substantial risers, by constructing a platform under the drain pan, or by hanging the unit from the ceiling trusses. As discussed in my patent application Ser. No. 11/320,992, filed Dec. 29, 2005, one improvement to the art is a drain pan with integrated risers that provide structural support for the air handler. When formed of plastic, that pan requires thicker material than ordinary pans in order to meet structural requirements and to withstand potentially high attic temperatures (140° F.). Yet the pan still must be set on a plywood platform for support. Also, pans in general are too flexible to hang under suspended air handlers without support as well.

SUMMARY

A secondary condensate drop-front drain pan is provided to capture any condensate that overflows from a primary drain pan of an air handling unit mounted above the drain pan. The drain pan, which may be thermoformed and unibody, comprises a drainage basin formed by a main basin portion, an auxiliary basin portion, and sidewalls that extend upwardly around a perimeter of the drain pan from both the main and auxiliary basin portions. The auxiliary basin portion, which is located along a single side of the pan, is stepped down relative to the main basin portion, being vertically displaced from it by an at least steeply sloping or alternatively vertical transition section. The transition portion may be flexible or convertible and operative to configure the drain pan between a stepped configuration and a standard configuration characterized by a non-stepped transition between main and auxiliary basin portions. When the main basin portion is positioned upon support beams, the auxiliary basin portion is configured to descend along or near a side or end of the front support beam and below a portion of the front support beam. The drain pan may also be provided with downwardly extending projections or lugs descending below the plane of the drainage basin to form notches or saddles for straddling or mounting the drain pan to support beams.

The secondary drain pan is provided using material that is as thin as those used in standard pans, provides the same elevation and access for the air handler as a pan with tall risers, and derives its structural support from standard materials used to elevate air handlers. The secondary pan can be installed in either a flat or elevated orientation, allowing for more options in the field. Further, the secondary pan may be nestably stackable.

These and many other embodiments and advantages of the invention will be readily apparent to those skilled in the art from the following detailed description taken in conjunction with the annexed sheets of drawings, which illustrate the invention.

BRIEF DESCRIPTION OF THE DRAWINGS

It will be appreciated that the drawings are provided for illustrative purposes and that the invention is not limited to the illustrated embodiment. For clarity and in order to emphasize certain features, not all of the drawings depict all of the features that might be included with the depicted embodiment. The invention also encompasses embodiments that combine features illustrated in multiple different drawings; embodiments that omit, modify, or replace some of the features depicted; and embodiments that include features not illustrated in the drawings. Therefore, it should be understood that there is no restrictive one-to-one correspondence between any given embodiment of the invention and any of the drawings.

Also, many modifications may be made to adapt or modify a depicted embodiment without departing from the objective, spirit and scope of the present invention. Therefore, it should be understood that, unless otherwise specified, this invention is not to be limited to the specific details shown and described herein, and all such modifications are intended to be within the scope of the claims made herein.

DETAILED DESCRIPTION OF THE INVENTION

Figure 1:
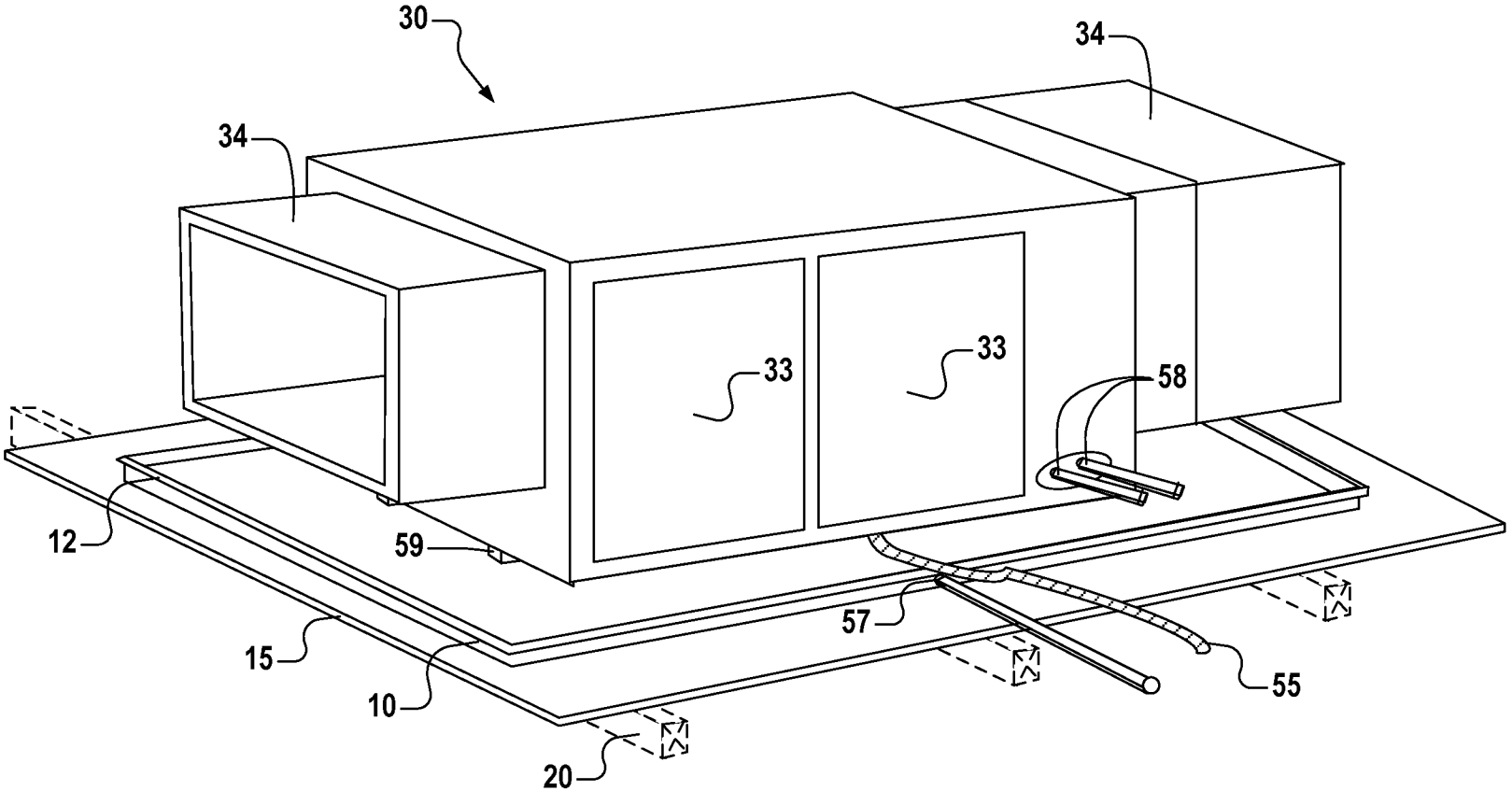
Fig. 1 Prior Art
FIG. 1 is a perspective view of a typical prior art horizontal air handler installation.

FIG. 1 illustrates a standard prior art secondary drain pan 10 mounted with and under a horizontal air handling unit 30 inside an attic. A sheet of plywood 15 placed on the framing joists or truss chords 20 forms a platform for the installation and provides a working area for the technician. The drain pan 10 is placed under the unit 30 in order to capture any leakage. Inside the unit 30 is a primary drain pan (not shown) that is equipped with one or more drainage outlets 58. The secondary drain pan 10 is also equipped with one or more drainage outlets 57. The unit 30 also may be equipped with p-traps (not shown) and condensate shut-off switches (not shown). Standard pans 10 typically have sides of 1.5" to 3" in height, with a small lip 12 around the upper perimeter, and substantially flat bottoms. The pan 10 may contain profiles (not shown) to add rigidity and yet allow drainage to reach the drainage outlet 57.

Units 30 are usually placed on anti-vibration pads or tall risers 59 to elevate the unit 30 out of any water in the pan 10. Elevation also helps with access to the unit 30 and removal of panels 33. In addition, units are typically elevated further to provide proper drain line pitch. This elevation may be achieved through additional risers (not shown) or by elevating the entire platform 15 under the pan 10. Newer drain pans 10 have integral risers to save contractors time and material. Upflow installations also use pans 10, but with a smaller footprint. Alternatively, both the unit 30 and the secondary drain pan 10 may be hung from attic rafters or other framing (not shown). Drain pans 30 are either hung under the unit, not bearing the weight of the unit 30, or are placed on a suspended platform. Metal pans may be favored when hanging, as they flex less. In all instances, the drain pan 10 remains stationary, held in place by supports, equipment, and completed ductwork 34.

Figure 2:
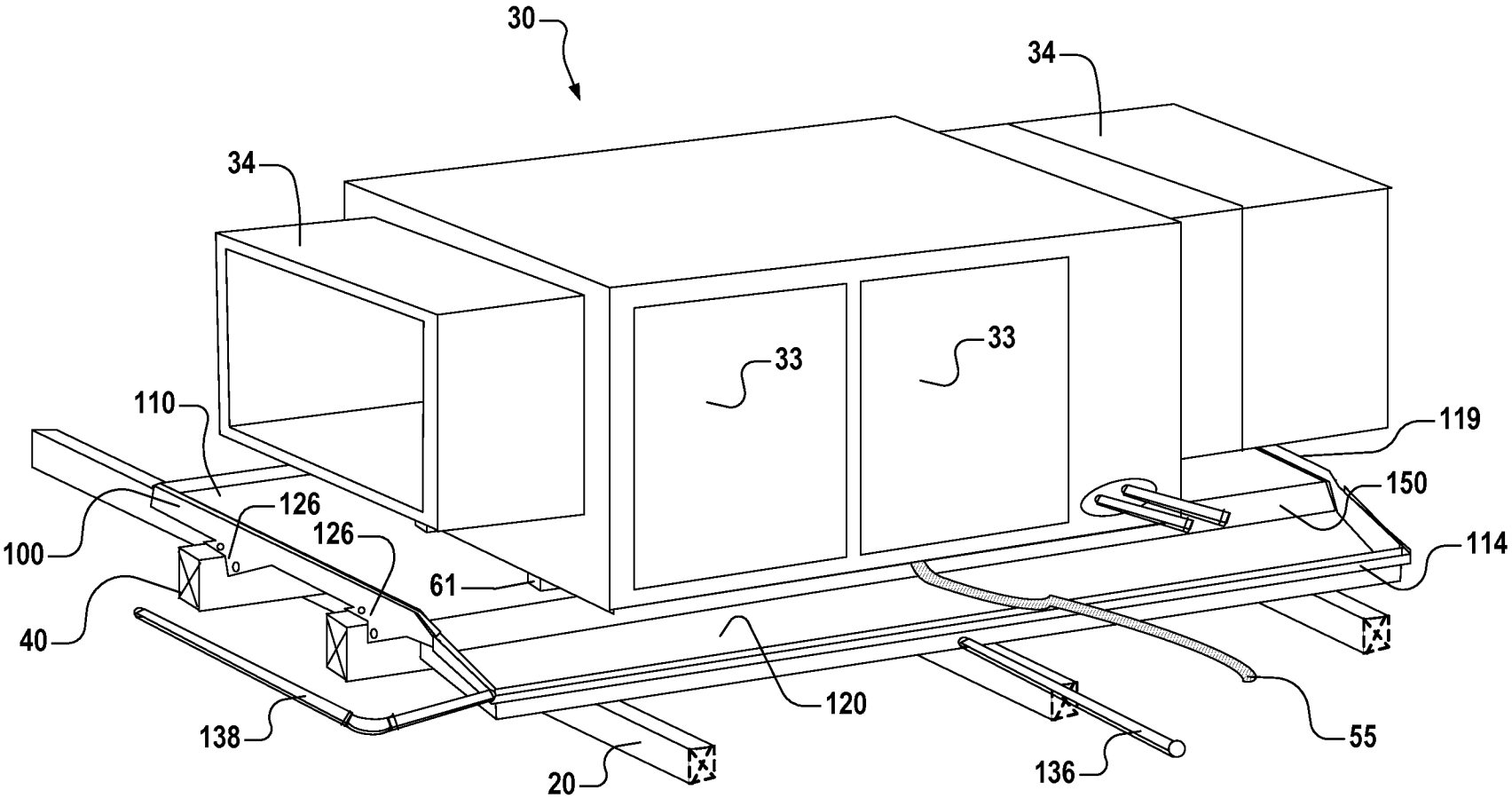
FIG. 2 is a perspective view of a horizontal air handler installation using an embodiment of a new drop-front drain pan.

FIG. 2 depicts an installation similar to that shown in FIG. 1, but incorporates an embodiment of a novel and nestably-stackable secondary condensate drop-front drain pan 100 configured to capture any condensate that overflows from a primary drain pan of an air conditioning unit 30 that is mounted above the drain pan 100. The drain pan 100 is, in one embodiment, thermoformed and unibody and, in another embodiment, made from sheet metal. The drain pan 100 comprises a drainage basin formed by a main or upper base or basin portion 110, an auxiliary lower base, basin, or trough portion 120, and sidewalls 119 that extend upwardly around a perimeter of the drain pan from both the upper base and trough portions 110 and 120. The trough portion 120 is located along only one side (e.g., a front side corresponding with the panels 33 of the unit 30, where a technician could most easily access it) of the drain pan 100. The trough portion 120 is also stepped down relative to the main base portion 110, vertically displaced from it by an at least steeply sloping or alternatively vertical transition section 150. When the upper base portion 110 is positioned upon support beams 40, the trough portion 120 descends along or near a side or end of the front support beam 40 and below a portion of the front support beam 40.

The drop-front drain pan 100 is adapted to be fitted over and take its structural support from elevating elongated support beams 40. Downwardly extending projections or lugs descending below the plane of the drainage basin form notches or saddles 126 for straddling or mounting the drain pan to the support beams 40. In this instance, 2" lumber of any desired height is placed on top of and attached to attic truss chords or other structural framing joists 20. Specifically, FIG. 2 depicts a 30"×60" drain pan 100 placed on top of elongated support beams 40 made of 2" lumber, with the pan 100 supported by and attached to the 2" lumber through saddles or notches 126 formed on the sides of the pan 100. The combination of 2" lumber plus drain pan 100 is used in place of a plywood platform 15, saving labor and material cost. Contractors may install longer pieces 40 of 2" lumber in order to distribute the load of the unit 30 across more truss chords 20. Attic insulation may be placed under the elevated drain pan 100. The air handling or air conditioning unit 30, with ductwork 34 attached, sits on top of anti-vibration pads 61, which in turn sit on the drain pan 100. The supports 40 and risers 61 do not interfere with condensate running to the front trough portion 120.

The upper base portion 110 of the drain pan 100 may be shallower than standard pans 10, with a sidewall height of about 1"-1.5", because the upper area routes water to the trough portion 120 and does not hold water. The short sidewall height, along with the elevation provided by the 2" lumber, allows for the use of short risers 61 under the unit 30. The unit 30 has sufficient drain line pitch. Even with short risers 61, the drop-front pan 100 allows access for the technician to open panels 33 and to connect a flexible gas pipe 55 under the unit 30 if needed. The drop-front trough portion 120 may have a primary or main drainage outlet 136 at its lower edge, and the sides of the trough portion 120 may be 1.5"-3" high in order to meet code. The front trough portion 120 also serves as a lightweight tool rest for the technician.

As illustrated in FIGS. 3-7, a transitional section 150 of the pan 100 that transitions from upper base portion 110 to the auxiliary base or trough portion 120 may be gusseted on the sides to enable the pan 100 to lie flat. Contractors in the field will appreciate a pan 100 with a convertible transition portion 150 that can convert the pan 100 from a standard or conventional substantially flat configuration 176 (FIG. 6) to a stepped drop-front configuration 174 (FIG. 7) that aids elevated installations. The expandable and/or bendable properties of the gussets 160 at key points or fold lines allow the pan 100 to transform between a drop-front or stepped configuration 174 and a standard or substantially flat pan configuration 176. Drainage channels (not shown) may run across the transition section or fold area 150, so that water may still drain when the pan 100 is in a standard, substantially flat configuration. Or, the channels of the gussets 160 may be much shallower than illustrated.

Figure 8:
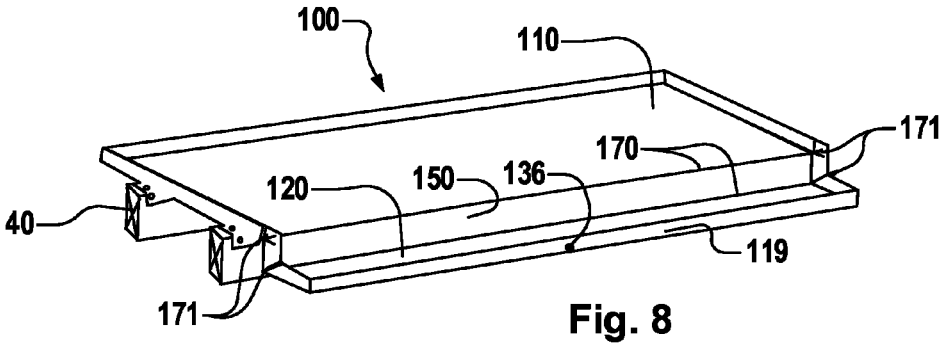
FIG. 8 is a perspective view of a convertible drop-front drain pan that employs living hinges to enable modification between stepped and standard configurations.

Alternatively, as illustrated in FIG. 8, the pan 100 may bend along a line, such as a living hinge 170 or other discrete fold, or may bend over a wider portion of material, as in the case of corrugated material. It also is envisioned that the pan 100 may fold in ways and locations other than those illustrated.

Figure 3:
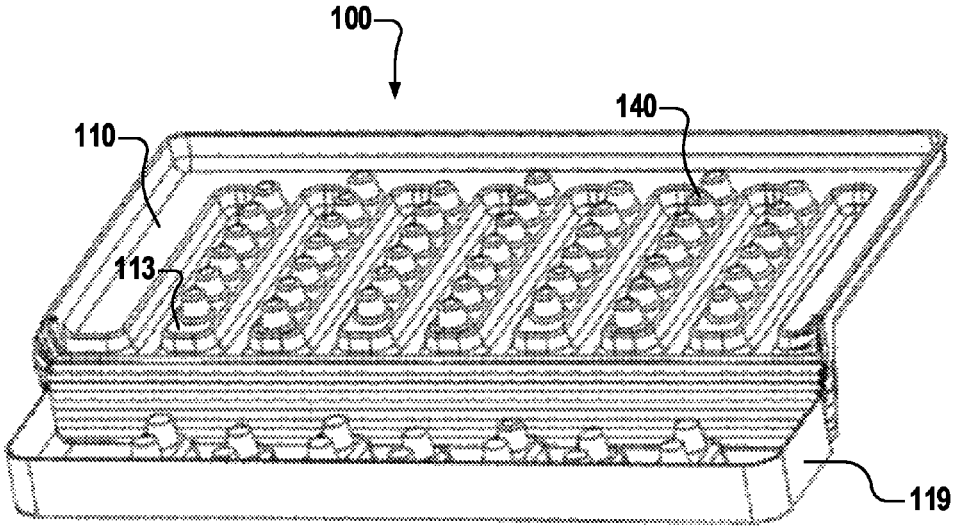
FIG. 3 is a perspective view of a convertible drop-front drain pan in a stepped configuration.
Figure 7:
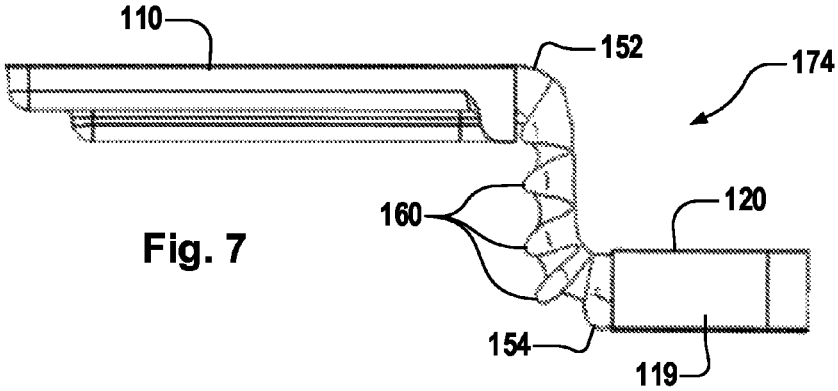
FIG. 7 is a side view of the convertible drop-front drain pan of FIG. 3 in a stepped configuration.

The pan 100, in the stepped configuration 174, as illustrated in FIGS. 3, 7, and 8, may be used on top of a suspension frame or on 2"×8" lumber for elevation. The sidewalls 119 are approximately 2" high. As best illustrated in FIG. 7, at the top bend 152, the gussets 160 are expanded to allow the downward bend of the trough portion 120, while maintaining leak-free continuity in the sidewalls 119 between the main base section 110 and the trough or front base section 120. At the bottom bend 154 of the trough portion 120, where the trough portion 120 begins to extend forward, the gussets 160 are compressed to hold the trough portion 120 in its roughly horizontal position. The gussets 160 may be secured to maintain the pan 100 in this position. The top of the transition portion 150 may have no upper lip in order to allow flexibility.

Further, the trough portion 120 may be secured to framing joists 20 or support beams 40 to maintain the stepped configuration 174 and anchor the drain pan 100 to its support. Typically, however, the drop-front drain pan 100 will not be installed directly on the truss chords or framing joists 20. Generally, elevating support beams 40 are contemplated to achieve a proper installation.

Figure 4:
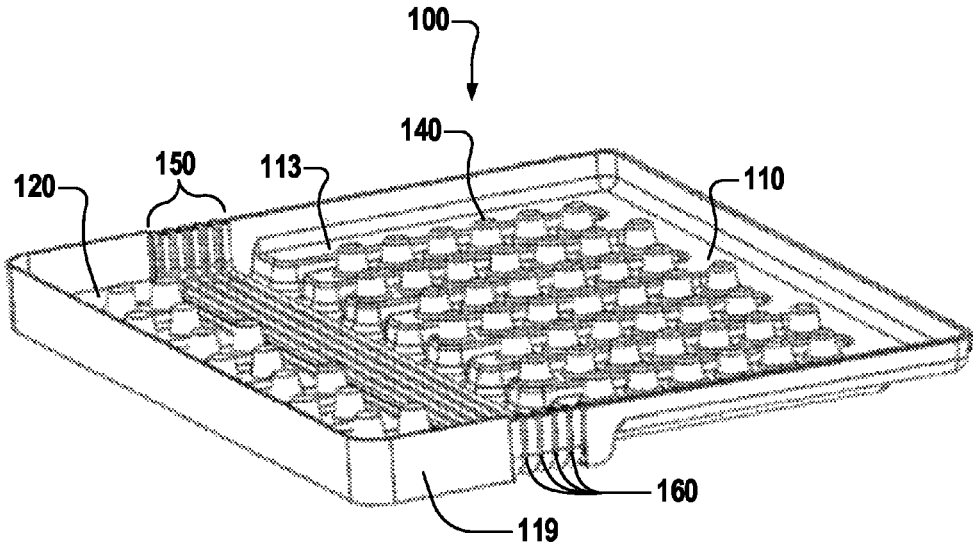
FIG. 4 is a perspective view of the convertible drop-front drain pan of FIG. 3 in a standard or substantially flat configuration.
Figure 5:
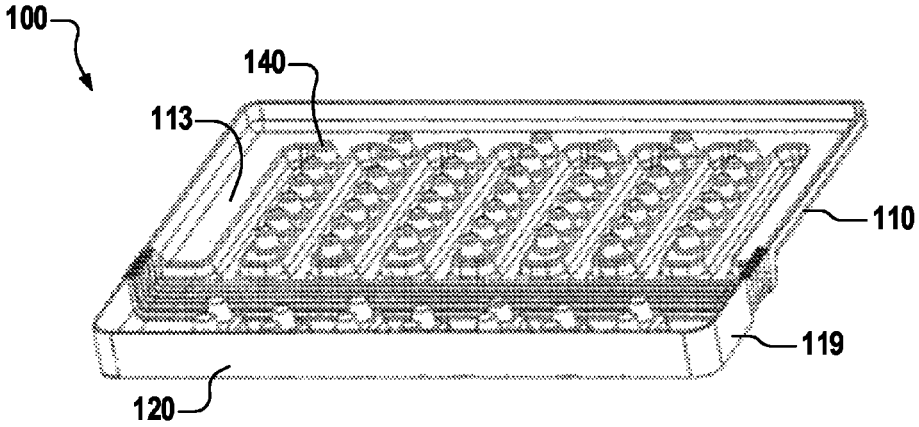
FIG. 5 is another perspective view of the convertible drop-front drain pan of FIG. 3, also in a standard configuration.
Figure 6:
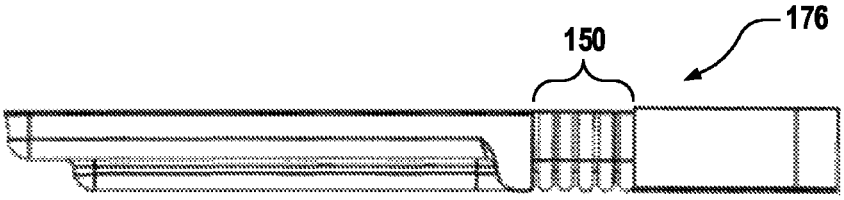
FIG. 6 is a side view of the convertible drop-front drain pan of FIG. 3 in a standard configuration.
Figure 13:
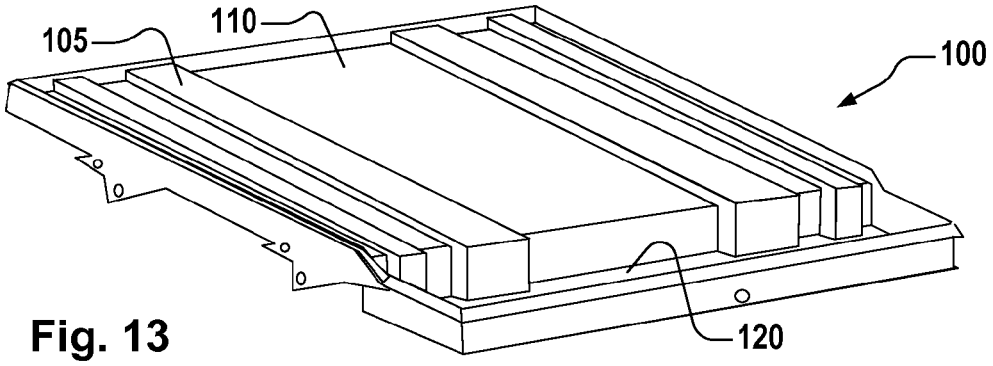
FIG. 13 is a perspective view of a drop-front drain pan with channels for front-to-back support beams.

Support beams 40 may run left to right under the entire drain pan 100, as shown in many of the drawings, or front to back within risers 113, as shown in FIGS. 3-5, and within corresponding underside channels 105 as shown in FIG. 13. Also, as shown in FIGS. 3-5, for example, cones or other molded risers 140 may elevate the unit 30 and transfer the load to the supports 40, or anti-vibration pads (not shown) or other materials may be used in place of the cones 140. The cones 140 may be further constructed to enable screws to run through the cones 140 and into the supports 40 without allowing condensate to escape through the cones (not shown). Certain cones 140 may also be reinforced with foam or other material to make them stronger.

As depicted in FIG. 7, the front "drop" is about 5", and the trough portion 120 is about 5" from front to back. The height and depth of the trough portion 120 are modifiable, of course, and when modified will change the overall dimensions of the drop-front and flat modes of the pan 100, as well as the difference in dimension between those two modes. A first drain hole 136 (FIG. 10) may be placed front and center, or at another location as needed. Other backup drain holes 138 (FIG. 10) may also be placed along various locations of the sidewall 119. The upper base portion 110 of the drain pan 100 channels water to the trough portion 120. As shown in FIGS. 3-5, risers or cones 140 may be integrally formed within the trough portion 120 in order to support an equipment unit 30 in the standard, substantially flat position. Risers 140 may be short or tall, and they may hold the equipment unit 30 level or at a slight angle in order to facilitate drainage from the primary pan (not shown) within the equipment unit 40.

FIGS. 4 and 5 show the drain pan 100 of FIG. 3 in its flat orientation, as if resting on plywood or a platform. If, for example, the pan in FIG. 3 is 27"×64" in folded position, the same pan in FIG. 4 is 32"×64" flat, with the same 2" height for the sidewalls 119 and a drain hole (not shown) front and center. This one pan 100 covers multiple popular sizes.

FIG. 8 illustrates an alternative configuration in which the drain pan 100 folds along discrete lines or folds or (in the case of plastic) living hinges 170 and corresponding sidewall gussets 171.

Figure 9:
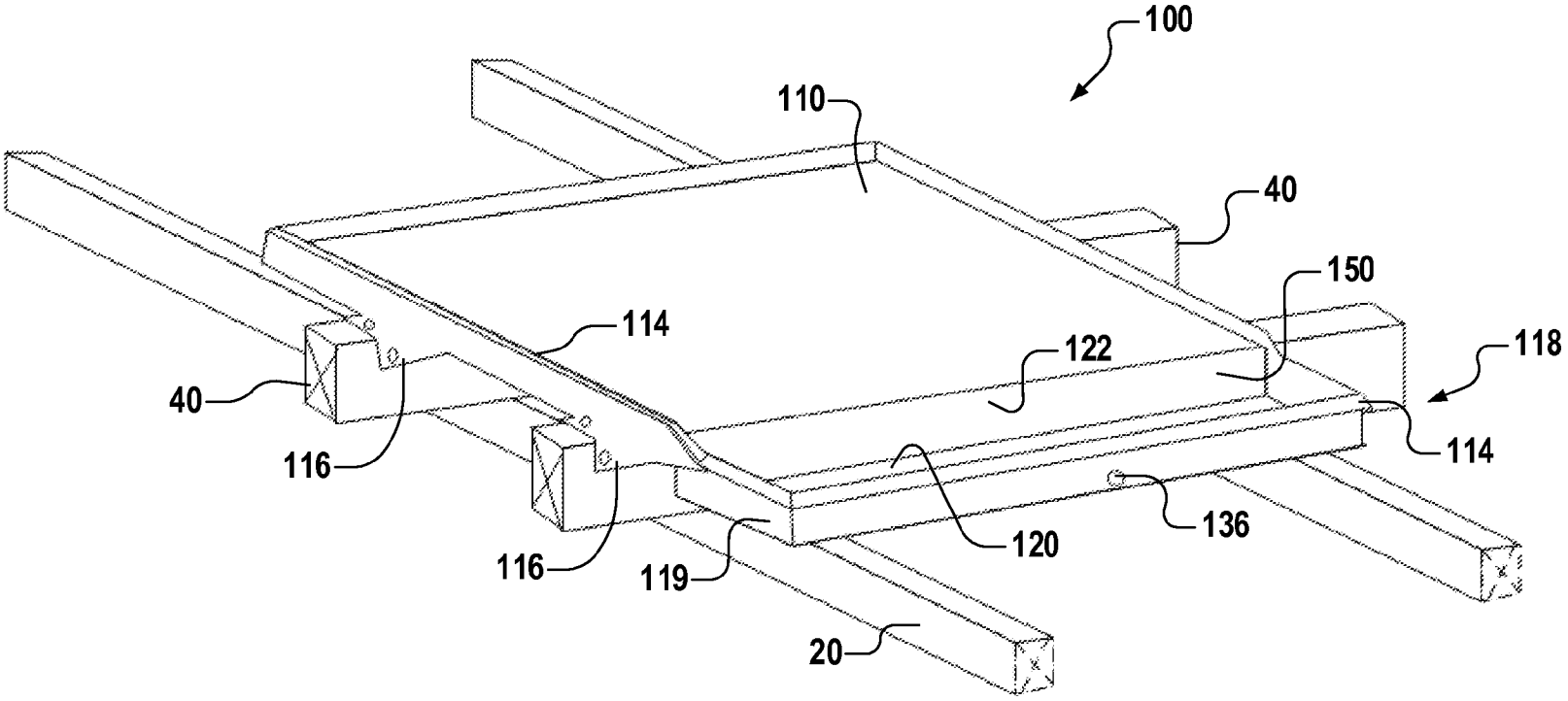
FIG. 9 is a perspective view of a square drop-front drain pan.
Figure 10:
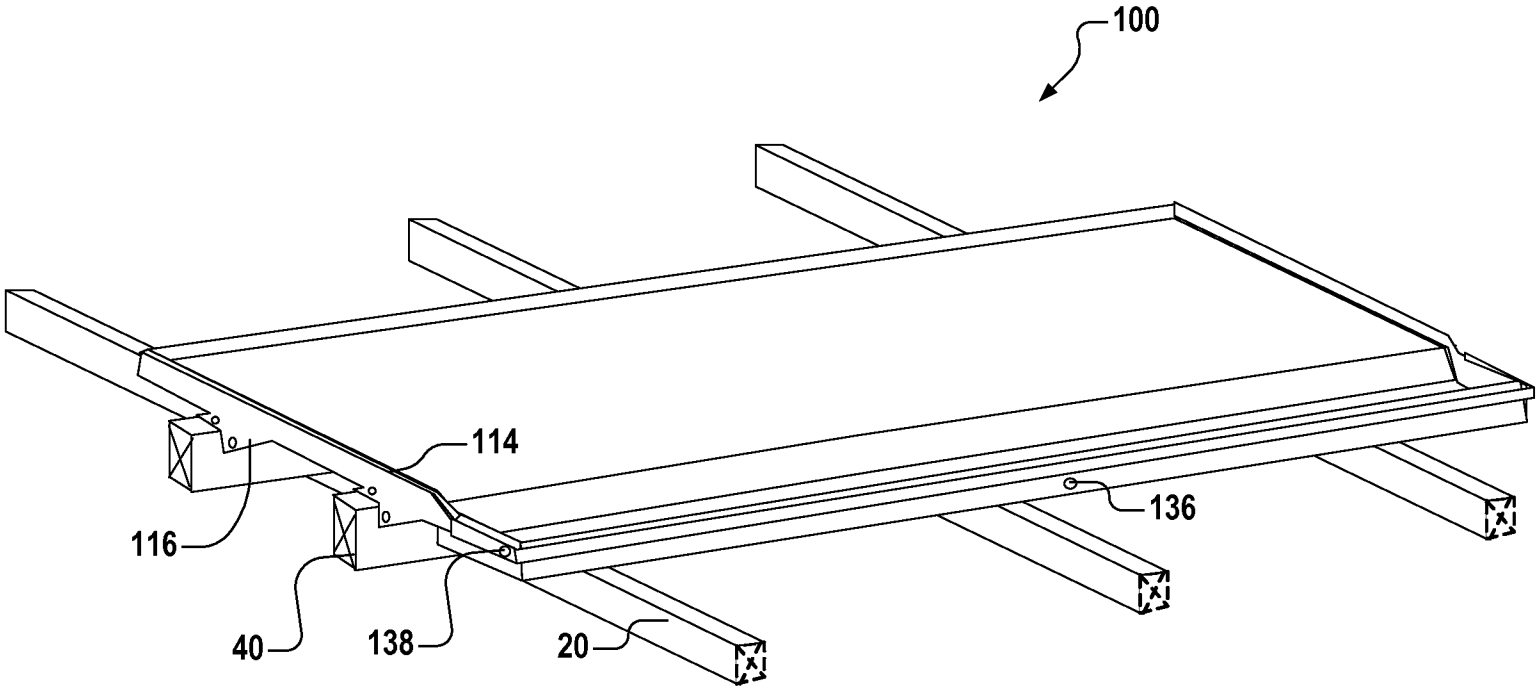
FIG. 10 is a perspective view of a rectangular drop-front drain pan.

FIGS. 9 and 10 show two sizes (24"×24" and 30"×60", respectively) of a drop-front drain pan 100. The pan 100 has a reinforcing lip 114 around the perimeter. The lip 114 includes lip extensions or lugs 116 that turn down, parallel to the sidewalls 119, that form notches or saddles 126 (FIG. 2) over the 2" lumber beams 40. As with many of the other embodiments, this pan 100 may be unibody (integrally formed) and nestably stackable with other pans 100. Such characteristics reduce storage space and minimize manufacturing and material cost.

Figure 11:
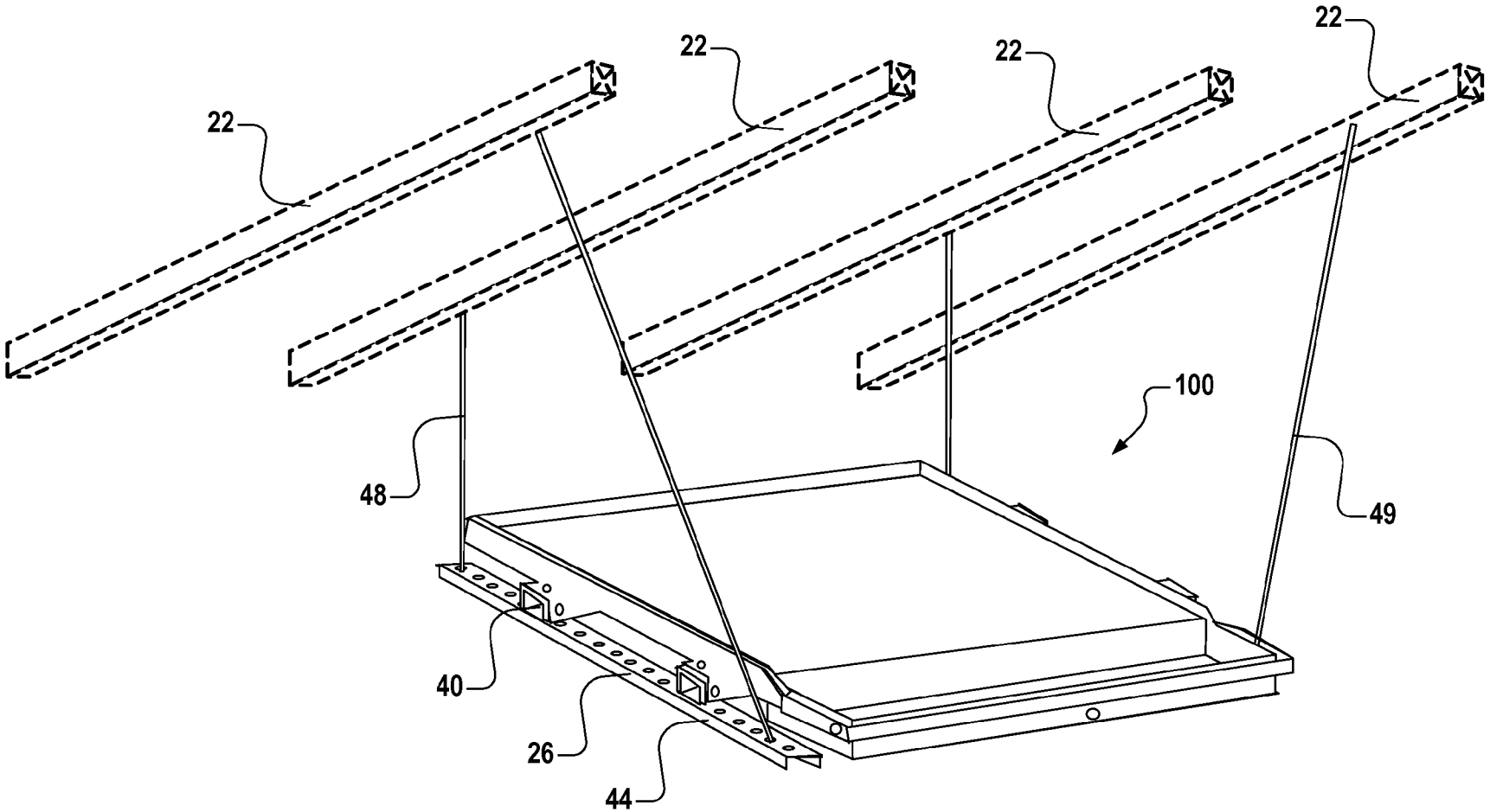
FIG. 11 is a perspective view of a drop front drain pan suspended from rafters.

FIG. 11 illustrates a square drop-front pan 100 hanging from the rafters 22 via threaded rods 48 and 49. Often, a pan will hang from just two rafters 22, but the illustrated configuration spreads the load across four. Other structural supports may replace the threaded rods 48 and 49, such as chains. Although not shown in FIG. 11 for purposes of clarity, the unit 30 itself may be hung from the rods 48 and 49, and any pan 100 suspended underneath, requiring its own support. Alternatively, a piece of plywood 15 may be suspended, with the pan 100 and unit 30 on top. FIG. 11 also illustrates pieces of angle iron or channel strut 44 running from front to back, along the side of the pan, to provide added stability and allow the hanging members 48 and 49 to be attached at the far corners of the pan 100, out of the way of ductwork and panel doors. The pan 100 may also be hung using 2" lumber or another rigid material instead of strut 44.

Figure 12:
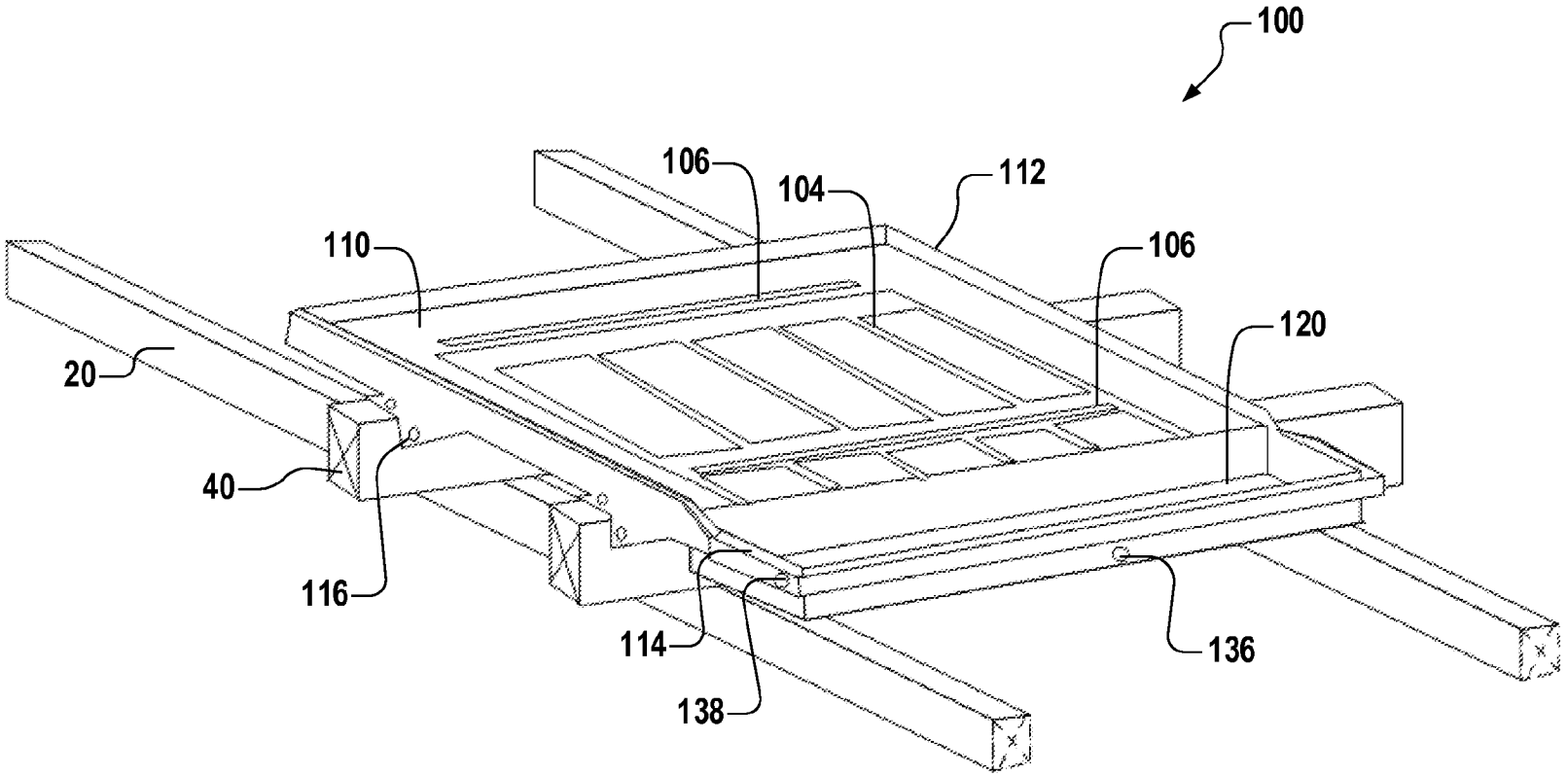
FIG. 12 is a perspective view of drainage channels formed in the bottom surface of the drop-front drain pan.

FIG. 12 shows the same square drop-front pan 100 with small channels 104 in the pan bottom to facilitate placement of anti-vibration pads and channel water to the front of the pan 100. Also shown are ribs or ridges 106, or raised areas of the pan bottom, to elevate the unit 30 slightly out of the water if no anti-vibration pads are employed. These channels 104 also form profiles that give the pan 100 added rigidity.

Figure 14:
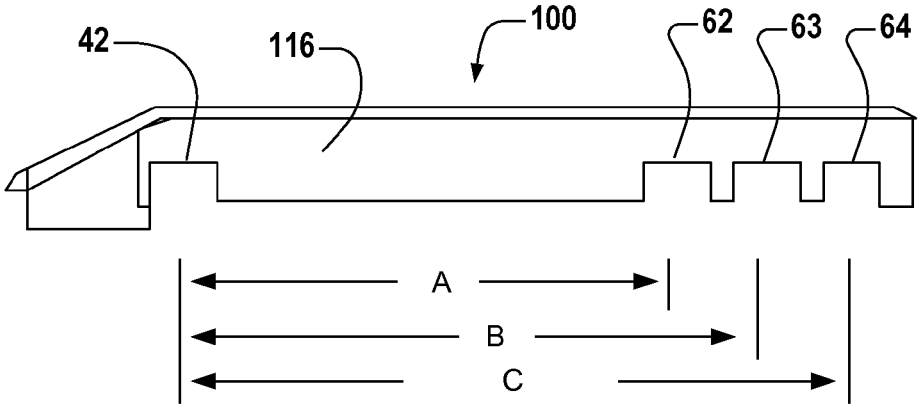
FIG. 14 is a side view of a drop-front drain pan with multiple notches for side-to-side support beams.

FIG. 14 illustrates a right side view of a pan 100 with multiple "saddles" or notches formed by downwardly extending projections or lugs in an extended, down-turned lip 116 to give the contractor more options for installation. Contractors are accustomed to 16" and 24" on center spacings, but given the sizes of popular drain pans, the actual spacing between support beams 40 may be closer to 20". Accordingly, the pan 100 includes a first notch 42 adjacent, and formed in part by, the drop front trough portion 120. Second, third, and fourth notches 62, 63, and 64, respectively, are spaced distances A, B, and C away (measured from the notch centers) from notch 42. For example, distances A", B", and C" may be 16", 20", and 24" respectively.

A variety of additional features are contemplated to facilitate installation of the drain pan 100. The drain pan 100 may be anchored, for example, by gravity, straps, lugs, saddles, screws through cones, zip ties, and other mechanisms, to support beams 40, the existing truss chords or framing joists 20, to a plywood surface 15, or to a hanging or cantilevered frame. The weight of the unit 30 on top and the stability of ductwork and piping may also aid in keeping the pan 100 in place.

Figure 16:
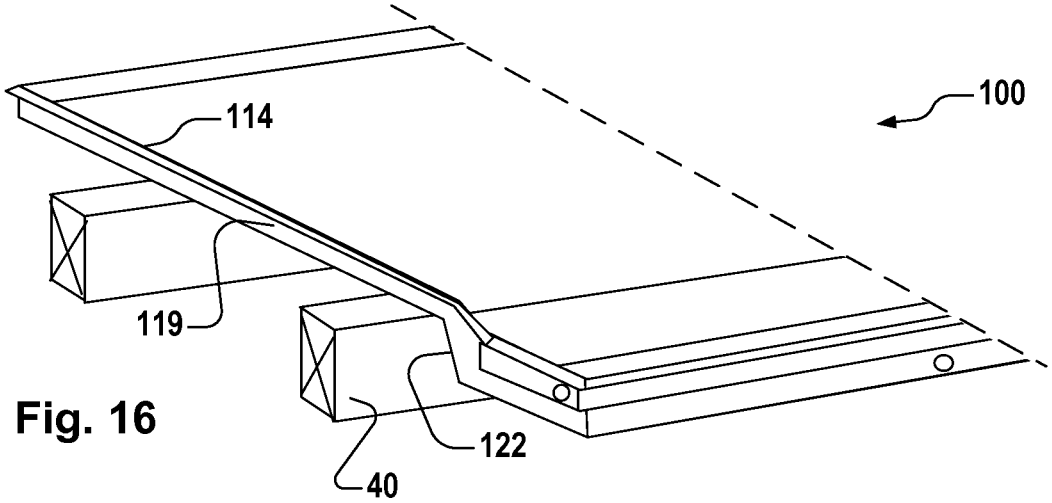
FIGS. 16-18 are perspective views of the side of a drop front drain pan using various structures for mounting or attaching the drop front drain pan to support beams.

FIG. 16 illustrates a pan 100 with a short lip 114 around the perimeter of the sidewalls 119. Here, no direct method of attachment is shown, but the back face 122 of the drop-front trough or lower base section 120 cozies up to the beam 40 in the front. A strap or other method of mechanical attachment may be used in the back to attach the lip 114 to the rear beam 40.

Figure 17:
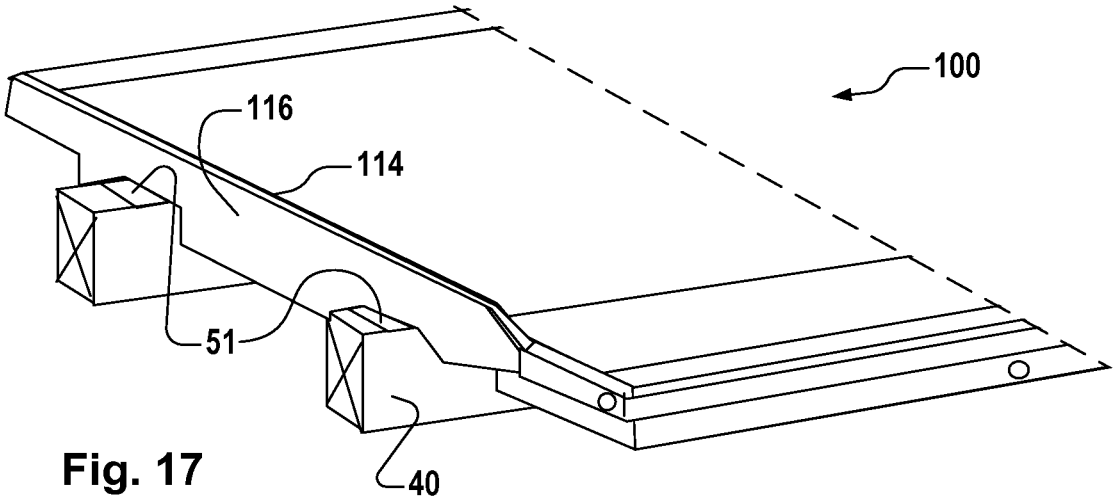

FIG. 17 illustrates 2" beams that pass through the sides of the pan 100 that are attached to the beams 40 via flaps or tabs 51, rather than a saddle, protruding from the side of the pan 100. The flaps 51 may extend directly from the pan side, where the side intersects the bottom. Alternatively, the pan lip 114 may turn down, further than the bottom of the pan 100, such that there is a gap between the pan side and the down-turned lip, and the flaps 51 are formed out of material from the lip extension 116.

Figure 18:
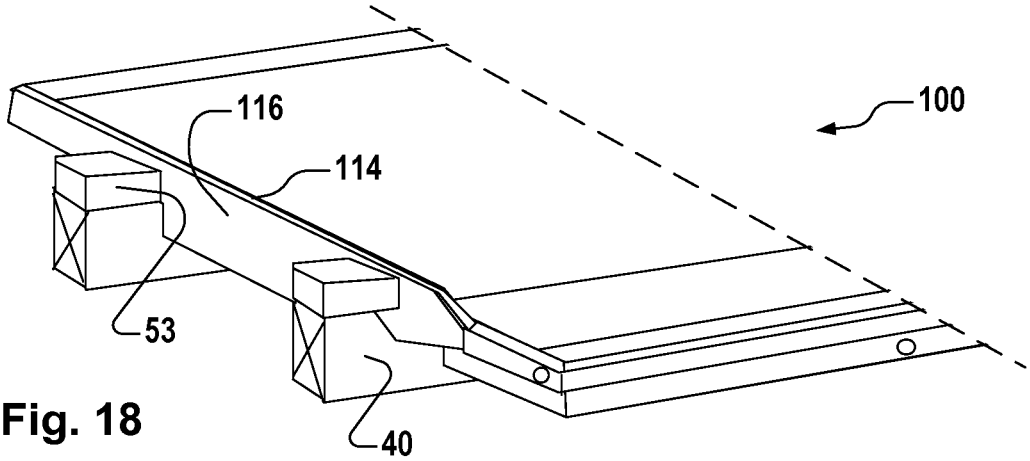

FIG. 18 illustrates blocks 53 (e.g., of wood) that are added to the top of the 2" beams 40 to pin the pan 100 in place.

Figure 19:
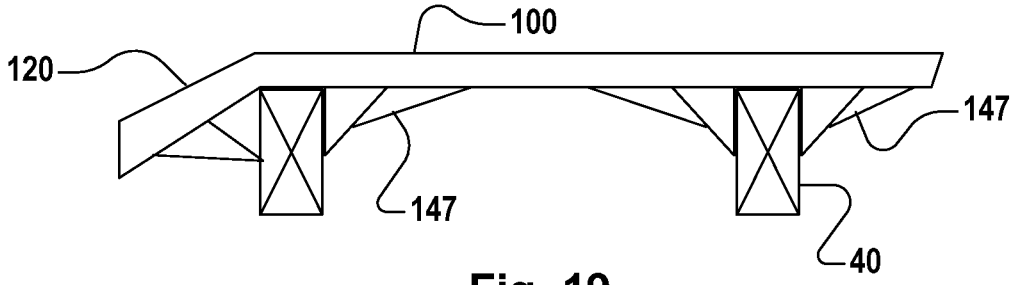
FIGS. 19-20 are side views of a drop front drain pan using various structures for providing additional support to the drop front drain pan to support beams.
Figure 20:
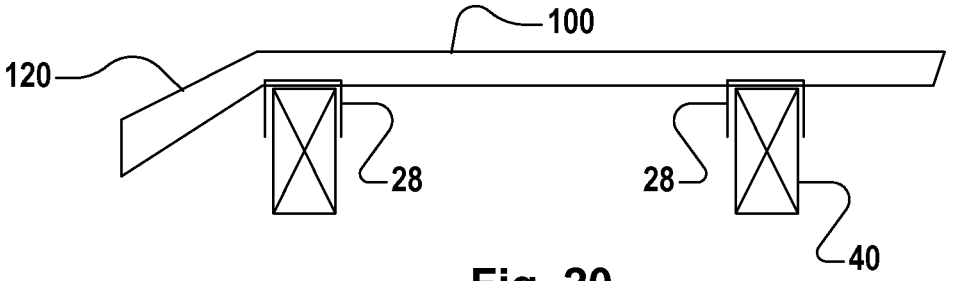

FIGS. 19 and 20 illustrate additional support that can be added around the support beams 40 to secure and/or support the pan 100. FIG. 19 uses ribbing 147, and FIG. 12 uses a u-channel type of clip 28 that may be embedded or added separately. If made of a somewhat flexible material that can be folded during storage, such supports may still allow the pan 100 to be stackable. In either case, the added supports do not affect the ability of the drainage to flow to the front of the pan.

Figure 21:
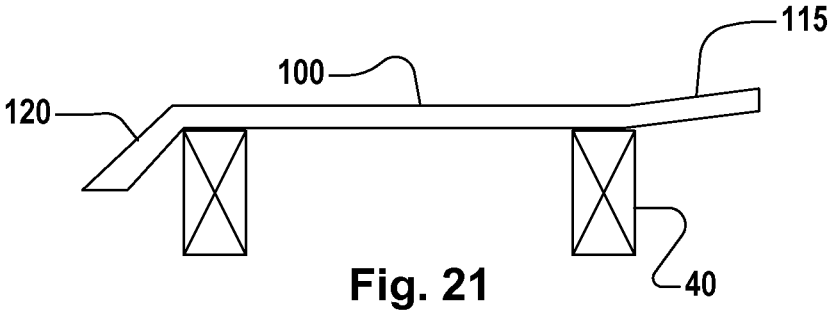
FIG. 21 is a side view of a drop-front drain pan with a sloped back section.
Figure 22:
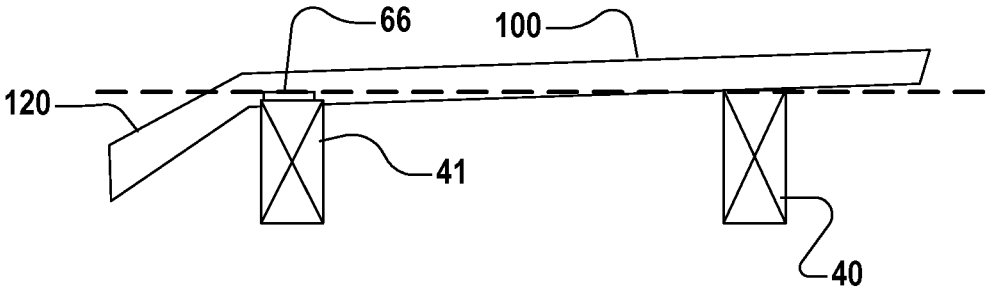
FIG. 22 is a side view of a fully sloped drop-front drain pan.

Flow of drainage is obviously important. FIG. 21 illustrates a pan 100 with an angled back 115 to make sure that water flows to the drop-front trough portion 120. FIG. 22 illustrates a slightly shorter 2" beam 41 in the front, near the drop-front trough portion 120, than the 2" beam 40 in the back, giving the pan 100 a slope. In FIG. 22, risers 66 would be placed inside the pan 100 on top of the front beam 41 in order to level any unit 30 mounted on the pan 100. Even with a substantially flat pan 100, the bottom surface may be formed so that it has a very slight downward slope to the front trough portion 120.

It should be noted that in FIGS. 18-22, many features of the drop front pan 100 have been omitted for simplicity.

Figure 15:
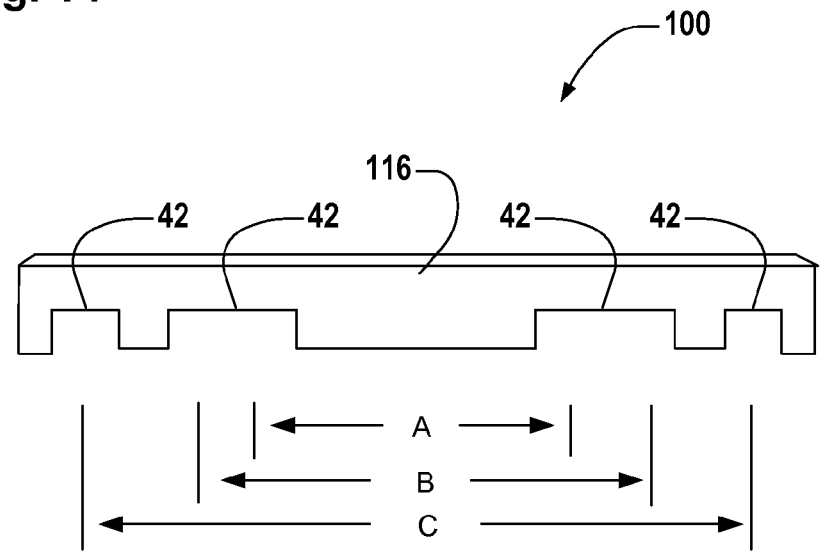
FIG. 15 is a rear view of a drop-front drain pan with multiple notches for front-to-back support beams.

Many of the described embodiments of the pan 100 are configured for, and show, support beams 40 running side to side under the drain pan 100. In some instances, a design may be preferred for support beams 40 that run front to back, as shown, for example, in FIGS. 3-7. FIG. 15 is a rear view of a drain pan 100 with an extended, down-turned lip extension 116 running adjacent the back sidewall. The descending lugs or projections of the lip extension 116 form notches or saddles 42 accepting beams spaced apart distances A, B, and C, which may be 16", 20", and 24" respectively. For simplicity, FIG. 15 does not show the drop-front trough 120 of the pan 100.

FIG. 13 also illustrates a configuration of the pan 100 designed to be mounted over front-to-back support beams. In this configuration, support beam receiving channels also rise above the bottom surface of the upper base portion 110 to form long, front-to-back risers, in the form of raised ribs or ridges 105, for elevating the unit 30. All drainage still flows to the drop-front trough portion 120.

In another embodiment, not shown, support beams 40 would run diagonally beneath the pan 100, and corresponding lugs, notches, saddles, and/or channels would also run, or be disposed, diagonally along the sidewalls 119 and/or underside of the pan 100.

Figure 23:
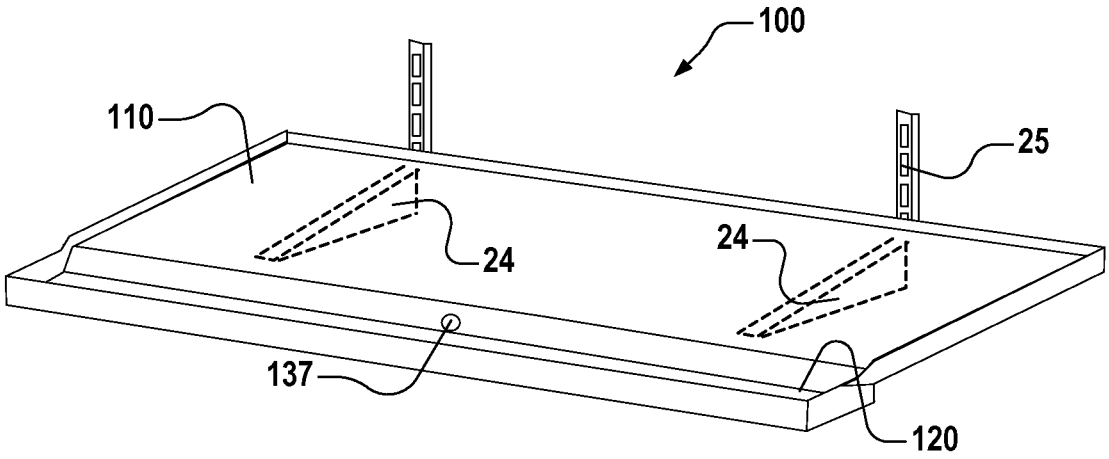
FIGS. 23-24 are perspective views of a drop-front drain pan installed on wall brackets for use with a mini-split installation.

Mini-splits are increasing in popularity, and those that function in heat pump mode may also require drain pans 100. The mini-splits are typically installed on wall brackets 25, with a standard drain pan 10 hanging underneath. FIG. 23 illustrates how installation of the drop-front drain pan 100 would provide a more uniform and attractive look for a mini-split installation. The pan 100 hides the bottom portion of the horizontal supports 24, and a drain hole 137, if needed, would go out the bottom/back of the drop front trough portion 120 of the pan 100.

Figure 24:
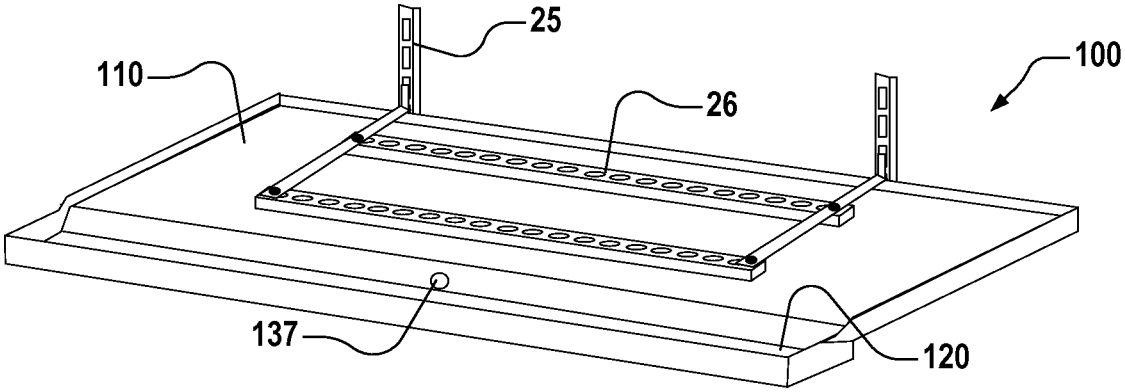

FIG. 24 illustrates an embodiment of a mini-split installation that installs the drop front drain pan 100 over the horizontal supports 24 (not shown), and then installs an additional metal frame 26, attached to the wall brackets 25, on or over the surface of the main base section 110 to support the mini-split unit. The drop-front pan 100 protects the frame 26 from standing water. It will be evident that the drop front drain pan 100 may also be used with traditional window units.

Although the foregoing specific details describe various embodiments of the invention, persons reasonably skilled in the art will recognize that various changes may be made in the details of the apparatus of this invention without departing from the spirit and scope of the invention as defined in the appended claims.

The present invention includes several independently meritorious inventive aspects and advantages. Unless compelled by the claim language itself, the claims should not be construed to be limited to any particular set of drawings, as it is contemplated that each of the drawings may incorporate features shown in others of the drawings.

I claim:

1. A drop-front secondary condensate drain pan for installation under an air handling unit, the drain pan comprising:

an upper base portion;

a trough portion located along a side of the drain pan and stepped down from the upper base portion;

wherein the drain pan is configured for mounting the upper base portion upon at least one support beam with the trough portion descending along or near a side or end of the support beam and below a portion of the support beam supporting the upper base portion;

a transitional section between the trough portion and the upper base portion that defines a substantially vertical, downwardly sloping surface configured to abut the drain pan to a vertical face of the support beam; and sidewalls around a perimeter of the drain pan extending upwardly from the upper base and trough portions, wherein the drain pan is contoured so that its sidewalls flare outwardly so that the drain pan is nestably stackable with another drain pan;

wherein the drain pan is configured to capture condensate that overflows from a primary drain pan of the air handling unit that is mounted above the drain pan.

2. The drain pan of claim 1, further comprising downwardly facing projections along the outside of the sidewalls, the projections being spaced for mounting a support beam.

3. The drain pan of claim 2, wherein the downwardly facing projections form a channel of approximately 1.5 to 2 inches in width to straddle an elongated support beam having a nominal 2-inch width.

4. The drain pan of claim 1, further comprising frame members for supporting the drain pan, at least some of the frame members extending beyond the perimeter of the drain pan for attachment to hanging members to hang the drain pan from overhead beams.

5. The drain pan of claim 1, further comprising integrally formed risers that extend upwardly from the upper base portion to provide a raised support surface capable of supporting the air handling unit.

6. The drain pan of claim 1, further comprising downwardly projecting lugs descending below the upper base portion and configured for straddling a support beam.

7. The drain pan of claim 6, wherein the lugs are integrally molded with the drain pan.

8. The drain pan of claim 6, wherein the sidewalls bend outwardly and downwardly to form an upper reinforcing lip, and continue downwardly in at least portions to form the straddle lugs that project below the drainage basin.

9. The drain pan of claim 6, wherein the drain pan is contoured so that its downwardly projecting lugs flare outwardly so that the drain pan is operable to be nestably stacked with another drain pan.

10. The drain pan of claim 6, wherein the downwardly projecting lugs are flexible so that they can be bent toward a horizontal direction to enable mounting of the drain pan on a flat platform.

11. The drain pan of claim 6, wherein the downwardly projecting lugs exist along opposite right and left sides of the drain pan to facilitate mounting of the drain pan to supports that run laterally beneath the drain pan.

12. The drain pan of claim 6, wherein the downwardly projecting lugs exist along a back sidewall to facilitate mounting of the drain pan to supports that run longitudinally beneath the drain pan.

13. A drop-front secondary condensate drain pan for installation under an air conditioning unit, the drain pan comprising:

a main base portion;

an auxiliary base portion located along a side of the drain pan;

a convertible transition portion located between the main base portion and the auxiliary base portion, the convertible transition portion being operative to transition the drain pan between a stepped configuration, where the auxiliary base portion is vertically displaced below the main base portion to form a trough, and a standard configuration characterized by a non-stepped transition between main and auxiliary base portions;

sidewalls around a perimeter of the drain pan extending upwardly from the main base portion, the convertible transition portion, and the auxiliary base portion;

wherein the drain pan is configured to capture condensate that overflows from a primary drain pan of the air conditioning unit that is mounted above the drain pan.

14. The drain pan of claim 13, wherein the convertible transition portion is gusseted and relatively flexible.

15. The drain pan of claim 14, wherein the convertible transition portion is bendable and operable to expand and collapse along a plurality of fold lines.

16. The drain pan of claim 13, wherein the convertible transition portion comprises one or more living hinges.

17. The drain pan of claim 13, wherein the main base portion is configured to capture condensate that overflows from the primary drain pan of the air conditioning unit that is mounted above the drain pan and to direct the overflow condensate to the auxiliary base portion.

18. The drain pan of claim 13, wherein the auxiliary base portion is configured to gather the condensate toward a drainage outlet.

19. A drop-front secondary condensate drain pan for installation under an air handling unit, the drain pan comprising:

a main base portion configured to be mounted on a support beam;

an auxiliary base portion;

a transitional portion between the main base portion and the auxiliary base portion that defines a substantially vertical, downwardly sloping surface configured to abut the drain pan to a vertical face of the support beam; and sidewalls around a perimeter of the drain pan extending upwardly from the main base portion, auxiliary base portion, and transitional portion;

wherein the drain pan is configured to capture condensate that overflows from a primary drain pan of the air conditioning unit that is mounted above the drain pan.

20. The drain pan of claim 19, wherein the transitional portion is operative to transition the drain pan between a stepped configuration, where the auxiliary base portion is vertically displaced below the main base portion to form a trough, and a standard configuration characterized by a non-stepped transition between the main base portion and the auxiliary base portion.

* * * * *